US008171962B2

(12) United States Patent
Chassaing

(10) Patent No.: US 8,171,962 B2
(45) Date of Patent: May 8, 2012

(54) DEVICE FOR FILLING AN AEROSOL CONTAINER WITH A LIQUID, FILLING ARRANGEMENT ABLE TO ACCOMMODATE SUCH A DEVICE AND CAP, AND AN AEROSOL CONTAINER EQUIPPED WITH SUCH A FILLING DEVICE

(75) Inventor: Antoine Chassaing, Clevilliers (FR)

(73) Assignee: Fillon Investissement, S.A., Faverolles (FR)

( * ) Notice: Subject to any disclaimer, the term of this patent is extended or adjusted under 35 U.S.C. 154(b) by 1086 days.

(21) Appl. No.: 11/494,489

(22) Filed: Jul. 28, 2006

(65) Prior Publication Data

US 2007/0062599 A1 Mar. 22, 2007

Related U.S. Application Data

(63) Continuation-in-part of application No. 11/348,272, filed on Feb. 7, 2006.

(30) Foreign Application Priority Data

Sep. 21, 2005 (FR) ..... 05 09611

(51) Int. Cl.
*B65B 1/04* (2006.01)

(52) U.S. Cl. ..... 141/20; 141/27

(58) Field of Classification Search ..... 141/200, 141/20, 25, 26, 27, 113
See application file for complete search history.

(56) References Cited

U.S. PATENT DOCUMENTS

| | | | | |
|---|---|---|---|---|
| 3,335,765 | A | 8/1967 | Moonan | |
| 3,338,022 | A * | 8/1967 | Moonan et al. | 141/20 |
| 3,430,819 | A | 3/1969 | Moonan | |
| 3,620,266 | A * | 11/1971 | Ryder | 141/20 |
| 3,797,534 | A * | 3/1974 | Skidmore | 141/3 |
| 4,869,403 | A | 9/1989 | Bruning | |
| 5,062,830 | A * | 11/1991 | Dunlap | 604/68 |

(Continued)

FOREIGN PATENT DOCUMENTS

DE 1 303 782 12/1974

(Continued)

OTHER PUBLICATIONS

Office Action dated May 26, 2010 in corresponding European Appln. No. 06778834.9.

(Continued)

*Primary Examiner* — Stephen M Hepperle
*Assistant Examiner* — William McCalister
(74) *Attorney, Agent, or Firm* — Young & Thompson

(57) ABSTRACT

Device for filling an aerosol container with a liquid using in particular a filling arrangement equipped with a pusher element (12), includes a cup designed to accommodate the liquid for filling the aerosol container, this cup being provided on its bottom with an injection opening adapted to the valve of the aerosol container, a piston head (7) acting by pushing on the filling liquid contained in the cup for transferring it from the cup to the container. The piston head (7) comes in the form of a scraper in continuous contact with the inside wall of the cup during the transfer operation. The piston head (7) is shaped to work with the cup after transfer to keep the piston head (7) within the cup to form an airtight wall that retains the residual liquid that has not been transferred within the cup.

10 Claims, 4 Drawing Sheets

U.S. PATENT DOCUMENTS

| | | | | |
|---|---|---|---|---|
| 5,535,790 | A * | 7/1996 | Hirz | 141/20 |
| 5,647,408 | A * | 7/1997 | Erste et al. | 141/20 |
| 5,740,841 | A * | 4/1998 | Hirz | 141/20 |
| 5,832,965 | A * | 11/1998 | Fasse et al. | 141/20 |
| 5,938,637 | A * | 8/1999 | Austin et al. | 604/72 |
| 6,302,163 | B1 * | 10/2001 | Zeigler | 141/20 |
| 6,705,359 | B1 * | 3/2004 | Zanellato et al. | 141/20 |
| 6,948,534 | B1 * | 9/2005 | Hirz | 141/20 |
| 7,252,119 | B2 | 8/2007 | Heatley | |
| 2005/0005995 | A1 * | 1/2005 | Pericard | 141/20 |
| 2005/0016622 | A1 * | 1/2005 | Risch et al. | 141/113 |

FOREIGN PATENT DOCUMENTS

| | | |
|---|---|---|
| DE | 4001528 | 7/1991 |
| DE | 299 04 071 | 7/1999 |
| DE | 10058283 | 6/2002 |
| EP | 0 282 872 | 9/1988 |
| EP | 0 440 477 | 8/1991 |
| EP | 1 034 847 | 9/2000 |
| JP | 5123727 | 7/1976 |
| JP | 7-242279 | 9/1995 |
| JP | 09-278006 | 10/1997 |
| JP | 2000081156 | 3/2000 |
| JP | 2004050015 | 2/2001 |
| WO | 01/09006 | 2/2001 |

OTHER PUBLICATIONS

Japanese Office Action, Application No. 2008-530560, dated Apr. 5, 2011.

Japanese Office Action, Application 2008-530560, mailed Aug. 23, 2011.

* cited by examiner

DEVICE FOR FILLING AN AEROSOL CONTAINER WITH A LIQUID, FILLING ARRANGEMENT ABLE TO ACCOMMODATE SUCH A DEVICE AND CAP, AND AN AEROSOL CONTAINER EQUIPPED WITH SUCH A FILLING DEVICE

BACKGROUND OF THE INVENTION

1. Field of the Invention

This invention relates to a device for filling an aerosol container with a liquid, such as paint, a filling arrangement able to accommodate such a device, a cap for an aerosol container, and an aerosol container equipped with at least one part of the filling device.

2. Description of the Related Art

Devices designed to promptly fill aerosol containers, comprising a mechanism with a cylinder and a piston, manually actuated, for injecting the substance into the aerosol container that already contains a propellant gas are already known from document CH 458 965. The cylinder encompasses the top end of the aerosol container and is kept in place above the aerosol using fixing means. This cylinder includes a tank that is designed to accommodate the substance to be injected into the aerosol.

The tank, which can be disposable, is located within the cylinder and follows its shape. There is an opening both on the bottom end of the cylinder and of the disposable tank, thus allowing passage of the substance to be injected into the aerosol. The presence of the disposable tank thus makes it possible to avoid the steps of cleaning the cylinder and therefore the disadvantages associated with them when the substance to be injected into the aerosol is changed.

According to the apparatus of this document, the terminal end of the piston is likewise covered by a plastic shell, likewise disposable, thus protecting the piston and likewise preventing its cleaning.

Unfortunately, such a disposable tank, even if it perfectly follows the inside contours of the cylinder, does not include a closure, and therefore remains open when the piston is withdrawn from the interior of the cylinder. As a result, even if the presence of the disposable tank in the cylinder prevents its cleaning each time the substance to be injected into the aerosol is changed, its manual withdrawal from the cylinder can entail soiling and/or contamination of the cylinder and/or nearby attachments, due again to the presence of residual substance in the bottom of the tank.

At the same time, the withdrawal of the protective shell of the piston requires the operator to make contact with the residual liquid covering the shell, the withdrawal operation being carried out manually.

Other filling arrangements that use a cup that is cleaned after each filling are known from the documents U.S. Pat. No. 5,740,841, EP-0,440,477 and FR-1,276,296.

SUMMARY OF THE INVENTION

One purpose of this invention is therefore to propose a filling device whose design makes it possible to prevent any operation of cleaning the filling arrangement implementing such a device at the end of the filling operation.

Another purpose of this invention is to propose a filling device whose design makes it possible, at the end of the filling operation, for the operator to avoid any direct contact with the filling liquid, while keeping any fouling away from the pusher element, such as the piston, of a filling arrangement.

Another purpose of this invention is to propose a filling device whose design makes possible its versatility and especially its use both as an aerosol filling device and cap.

Another purpose of this invention is to propose a filling arrangement whose design makes it possible to use a filling device of the aforementioned type on an expendable basis.

Another purpose of this invention is to propose an aerosol container whose cap design allows its implementation in the form of a multifunctional piece so as to reduce the cost of the operation of filling such an aerosol container.

To do this, the object of the invention is a device for filling an aerosol container with a liquid, such as paint, using in particular a filling arrangement equipped with a pusher element, this filling device comprising a cup that is designed to accommodate the liquid for filling the aerosol container, this cup being provided on its bottom with an injection opening that can be adapted to the valve of the aerosol container, a piston head acting by pushing on the filling liquid contained in the cup for transferring it from the cup to the container, characterized in that the piston head comes in the form of a scraper in continuous contact with the inside wall of the cup during the transfer operation, this piston head being shaped to work with the cup to keep, after transfer, the piston head within the cup to form an airtight wall that retains the residual liquid that has not been transferred within the cup.

Keeping the piston head within the cup at the end of the filling or transfer operation allows withdrawal of the single pusher element of said cup when the latter is present, thus keeping the cup free from fouling. The pusher element is thus ready to be re-used in working with a new piston head for a new filling operation.

At the same time, keeping the piston head within the cup allows the residual liquid that has not been transferred to be retained within the cup between the piston head and the wall that forms the bottom of said cup, so that the cup can be manipulated, i.e., reversed, without the risk of soiling the hands of the operator by the residual liquid that has not been transferred remaining within the cup.

The invention also has as its object a cap for an aerosol container that can be filled with a liquid, such as paint, through its valve, by said valve working with a filling device comprising at least one cup, designed to accommodate the liquid for filling the aerosol container, said cap being designed to encompass the valve of the aerosol container, characterized in that the cap is shaped like a cup that is provided on its bottom with an injection opening that can be adapted to the valve of the aerosol container to constitute, during the phase of filling the aerosol container, the cup for accommodation and transfer of the filling liquid of the aerosol container of the filling device, this filling device preferably being of the aforementioned type.

According to a preferred embodiment of the invention, the cap is, prior to its filling the aerosol container with filling liquid, pre-equipped with a piston head coupled to the cap in a detachable manner, whereby this piston head is able, in the state uncoupled from the cap, to act by pushing on a filling liquid introduced into the cap for the transfer of the liquid to the aerosol container.

The invention also has as its object the use of the cup of the filling device of the aforementioned type as a cap of an aerosol container.

The invention also has as its object a piston head of the type that is designed to act by pushing on the filling liquid of an aerosol container contained in a cup that is provided on its bottom with an injection opening for transferring said liquid from the cup to the container during the adaptation of the injection opening of the cup to the valve of the aerosol container, characterized in that it comes in the form of a circular part equipped with a scraper segment of radial sealing, whereby this head can work with the cup to form a single-use filling device.

The invention also has as its object an aerosol container that can be filled with a liquid, such as paint, through its valve, by said valve working with a filling device that comprises at least one cup that is intended to accommodate the filling liquid of the aerosol container, whereby this cup is provided on its bottom with an injection opening that can be adapted to the valve of the aerosol container, characterized in that it is equipped with a transfer cap formed by at least one cup of the filling device, whereby this filling device is preferably of the aforementioned type.

The invention also has as its object an arrangement for filling with a liquid, such as paint, an aerosol container of the type comprising a frame that marks the boundary of a preferably closed chamber, means for keeping a cup of filling liquid within the chamber, in a position located above the position of the aerosol container, in a position of contact with the valve of said container, a pusher element that can move axially in said cup to cause, by pushing on the liquid, the transfer of this liquid through an opening of the cup into the aerosol container, characterized in that the pusher element is equipped with a detachable piston head that can be separated from the pusher element within the cup before withdrawal of the pusher element from said cup in such a way as to keep the pusher element free of fouling as it is being moved.

BRIEF DESCRIPTION OF THE DRAWINGS

The invention will be better understood by reading the following description of embodiments with reference to the attached drawings in which.

DETAILED DESCRIPTION OF THE INVENTION

Figure 3:
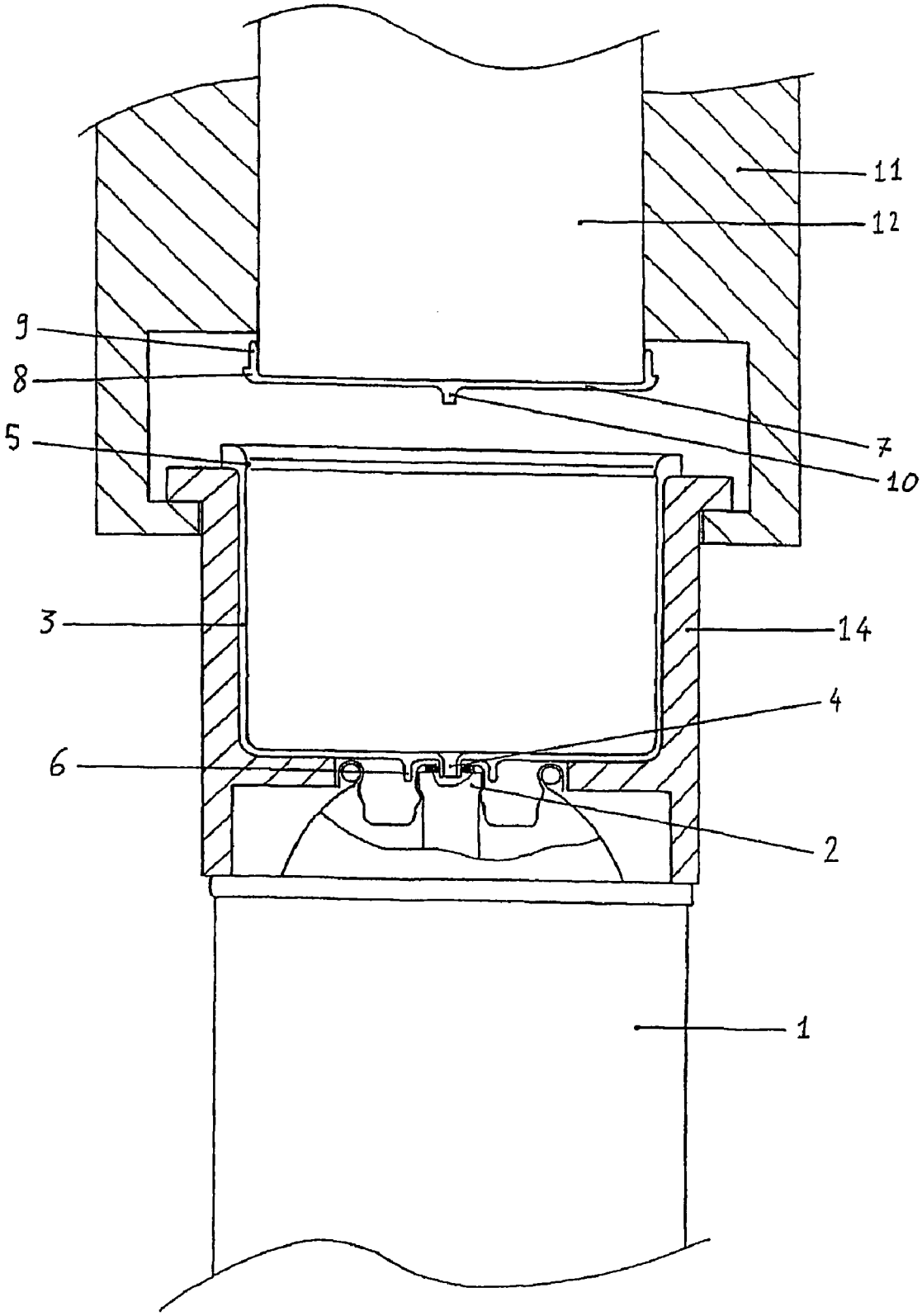
FIG. 3 shows a partial cutaway view of a filling arrangement according to the invention in a position prior to transfer of the pusher element.

As mentioned above, the filling device, the object of the invention, is more especially designed to allow an aerosol container 1 of the type of the one shown partially in FIG. 3 to be filled with a liquid, in particular paint. This aerosol container 1 generally comes in the form of a cylindrical body provided with a valve 2 on its top part. A detachable diffuser, not shown, which makes it possible to diffuse the liquid contained within the aerosol container into the atmosphere, is mounted above this valve 2. This diffusion is obtained using a propellant gas contained within the aerosol container. The aerosol container 1 is filled with the liquid to be sprayed by the valve 2 of the aerosol container 1. To do this, it requires a filling device of the type of the one according to the invention. This filling device is generally used in working with a filling arrangement equipped with a pusher element 12, although it can also be used alone.

The filling device conventionally comprises a cup 3 that is designed to accommodate the liquid that fills the aerosol container 1. On its bottom, this cup 3 is provided with an injection opening 4 that can be adapted to the valve 2 of the aerosol container 1. A piston head 7 acts by pushing on the filling liquid contained in the cup 3 for transferring it from the cup 3 to the container 1. Thus, the cup 3 is positioned first with its injection opening 4 opposite the valve 2 of the aerosol container 1, said opening 4 with its projection 4A being inserted into the valve 2. The filling liquid contained within the cup 3 is transferred from the cup 3 to the container 1 under the action of axial displacement of the piston head 7 within the cup 3. The filling arrangement makes it possible to act on the piston head 7 and to drive the latter into motion within the cup using a pusher element 12.

Characteristically of the invention, the piston head 7 comes in the form of a scraper in continuous contact with the internal wall of the cup 3 during the transfer operation, this piston head 7 being shaped to work with the cup 3 to keep the piston head 7 within the cup 3 after transfer. This piston head 7 thus forms an airtight wall that retains the residual liquid that has not been transferred within the cup 3.

The piston head 7 can be kept within the cup 3 by a large number of means. Thus, this holding action can be carried out by elastic tightening of the wall of the cup 3 around the piston head 7. The piston head 7 in this case is forced into the interior of the cup 3. It is likewise possible to provide, within the cup 3, an internal peripheral collar that keeps the piston head 7 within said cup during axial displacement of the pusher element in the direction of the outside of the cup. Again, it is likewise possible, at the level of the piston head 7, to provide elastically deformable tabs that, in the course of insertion of the piston head 7 within the cup 3, become deformed in order to apply contact along the cup and to prevent any withdrawal of the piston head 7 from the cup during withdrawal of the pusher element 12, due to the forces of friction that have developed between the piston head 7 and the cup 3.

The piston head 7 being kept within the cup 3 makes it unnecessary for the operator to have to handle this piston head 7 in contact with the liquid to be transferred. Thus, the pusher element 12, when it is removed from the cup, is free of any fouling and can be covered with a new piston head 7 for a new transfer operation.

Figure 1:
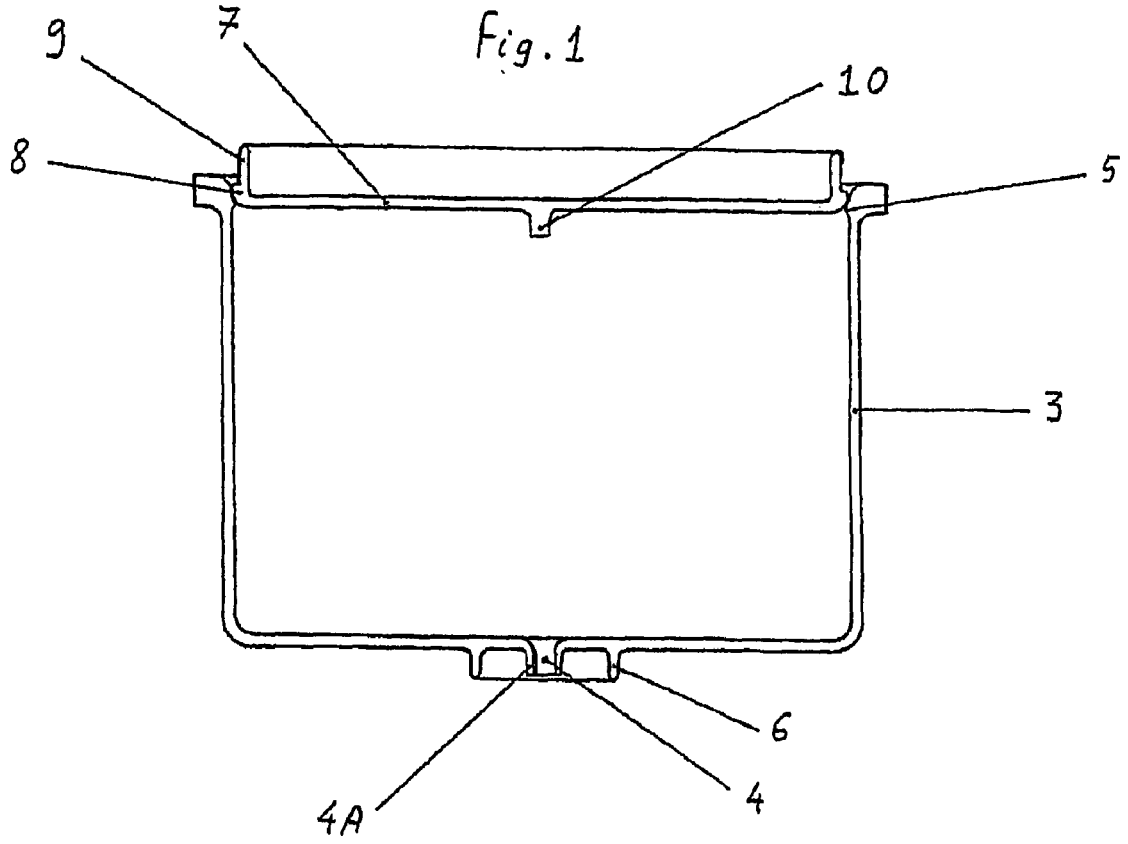
FIG. 1 shows a cutaway view of a filling device according to the invention, the piston head having been shown in a starting position of transfer of the filling liquid to the aerosol container.
Figure 2:
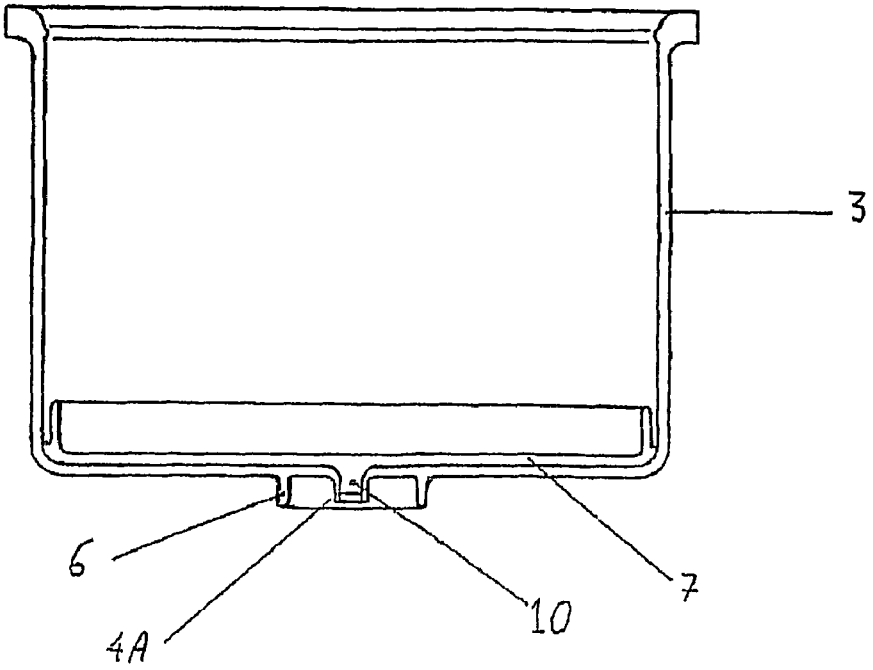
FIG. 2 shows a cutaway view of a liquid filling device according to the invention in the position of the end of transfer of the piston head.

In the examples shown, the piston head 7 is kept within the cup 3 in the transfer completion position adjacent to the bottom of the cup 3 and in which it blocks the injection opening 4 of the cup 3. This position is more particularly visible in FIG. 2. This position thus makes it possible to prevent any fouling of the filling arrangement when the operator is led to remove the cup 3 from the aerosol container. To allow this blocking of the injection opening 4 of the cup 3 by the piston head 7, the piston head 7, which has the form of a circular disk, at the center of its outer surface in contact with the liquid, has a projecting seal 10 that is designed to block the injection opening 4 of the cup 3 for air tightness.

In the embodiment shown, the injection opening 4 of the cup 3 is extended externally by a projection 4A that forms an injection nozzle that can be positioned on the valve 2 of the aerosol container 1 and that can be inserted into the latter. This nozzle is surrounded by a ring 6 that protects the end of the injection nozzle. The ring 6 thus makes it possible to prevent any contact of the operator's fingers with the end of the projection 4A. It likewise makes it possible to protect the projection 4A from any damage during various manipulations of the cup 3, including prior to the transfer operation. It is thus understood that the seal 10, in the position at the end of transfer, penetrates within the nozzle and blocks the latter.

During the transfer operation that allows the piston head 7 to be moved into a position in which it extends to the vicinity of the bottom of the cup 3, it is necessary to have a pusher element 12 of a filling arrangement act. This pusher element 12 generally comes in the form of a pneumatic or hydraulic cylinder. The rod of this cylinder is then encompassed by the piston head 7. This piston head 7 comes in the form of a circular disk with a scraper segment 8 for radial air tightness. This disk is extended by a circular skirt 9 designed to encompass the pusher element 12, generally of the cylinder type of a filling arrangement. Thus, the piston head of the pusher element 12 is easily mounted and dismounted because of the fact that the piston head 7 is mounted by simple interlocking on the end of the pusher element 12.

Preferably, the cup 3 is made of a transparent or translucent material to allow in particular the nature of the transferred liquid to be viewed. Thus, the residual liquid retained between the piston head and the bottom of the cup 3 is visible to the operator. When the liquid is paint, the operator can thus identify at a glance the color of the paint that has been transferred.

This identification is particularly important when the cup 3 is, moreover, designed to comprise the cap of the aerosol container 1. Actually, as the transferred material is retained within the cup, this cup can be used as the cap of aerosol container 1 once the transfer operation has been carried out. To this end, the cup 3 in the vicinity of its opening has an undercut 5 that forms an immobilizing element by working with an edge of the aerosol container 1 to constitute the cap of the aerosol container 1. Again, the possibility of viewing the color of the transferred liquid in said container on the cap allows any user to have information on the contents of the aerosol container by simply looking at the cap of said container.

In this configuration, the cup 3 and the piston head 7 are thus made in the form of single-use, disposable articles. Before the transfer operation, this cup 3 and this piston head 7 can be stored on the aerosol container, the piston head 7 being housed within the cup generally with the diffuser of the aerosol container. The piston head 7 in this case is housed within the cup 3, taking care to immobilize it in the position in which the pusher surface of the piston head is not parallel to the surface that forms the bottom of the cup, at the risk of otherwise retaining the piston head 7 within the cup 3 and no longer being able to use the piston head 7 for the transfer operation.

Figure 6:
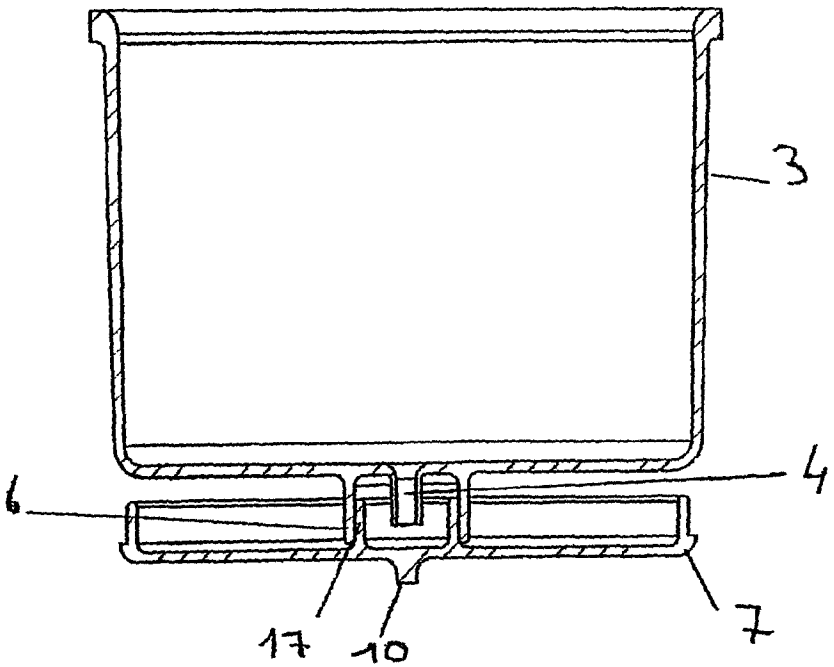
FIG. 6 shows a cutaway view of the piston head and the cup before the stage of transfer to the assembled state in a detachable manner.
Figure 5:
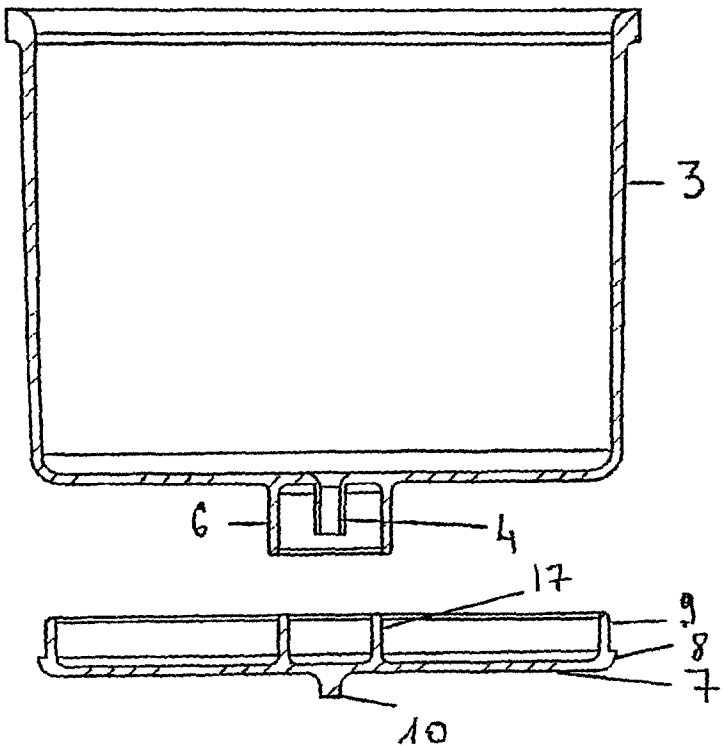
FIG. 5 shows a cutaway view of the piston head and the cup before the stage of transfer to the disassembled state.

In another embodiment shown in FIG. 6, the piston head 7 is placed outside the cup 3 that forms the cap and is coupled to the cap in a detachable manner. This coupling makes it possible to prevent any loss of the piston head 7 during the phases of transport and storage of the cap before the filling stage. This coupling also makes the transfer operation of the cap non-operational, the piston head 7 sealing the injection opening 4. In addition, the arrangement of the piston head 7 that is applied against the outside face that forms the bottom of the cap prevents any positioning of the cap in the cup-holder of a filling arrangement. As a result, the operator is obliged to disengage the piston head 7 from the cap before the transfer stage. Once the disengagement operation is performed, the operator should not fail to position the piston head 7 on the pusher element. In the examples shown, the piston head 7 is coupled to the cap by a link with an interlocking arrangement. To this end, the piston head 7 is equipped on its face, opposite to that provided with a seal 10, by a hollowed-out pin 17, whereby this pin 17 is housed inside the ring 6 surrounding the injection opening 4 of the cap in the space that is left free between the ring and wall of opening 4. The disengagement of piston head 7/cup-cap is performed by simple traction exerted on the piston head 7 to obtain two parts according to FIG. 5. The piston head 7 is then positioned to be introduced into the cap up to a position in which it will be ultimately held inside the latter.

The transfer operation can be carried out using a filling arrangement of the type, for example, of the one shown partially in FIG. 3. This filling arrangement comprises a frame 11 that marks the boundary of a chamber that is preferably closed using a gate for reasons of safety. Within this chamber, there are means 14 for keeping a cup 3 of filling liquid within the chamber in a position located above the position of the aerosol container 1 in a position of contact with the valve 2 of said container 1. These holding means 14 can assume a large number of forms. They have been shown partially in FIG. 3 in the form of a hollow cylinder that accommodates the cup 3 and keeps it in a predetermined position, this cylinder 14 itself being kept integral with the frame 11 of the arrangement by suitable coupling means.

This arrangement comprises a pusher element 12 that can move axially in said cup 3 to cause, by pushing on the liquid, the transfer of this liquid through an opening 4 of the cup 3 into the aerosol container 1. This pusher element 12 is generally comprised of a cylinder with pneumatic or hydraulic actuation. The pusher element 12 is equipped with a detachable piston head 7 that can be separated from the pusher element 2 within the cup 2 before withdrawal of the pusher element 12 from said cup 3. Thus, when the pusher element 12 has been removed from the cup 3 at the end of the transfer operation, it has not been fouled and can be re-equipped with a new piston head 7 that thus comprises a single-use, disposable piece. It can be easily understood from looking at FIG. 3 that the axial displacement of the rod 12 of the pusher element in the direction of an extension of the cylinder rod drives the piston head 7 into a sliding displacement within the cup in the direction of the bottom of the cup. Conversely, the movement of the pusher element 12 in the direction of a retraction of the rod of the pusher element drives an exit of the rod of the pusher element 12 from said cup 3, the piston head 7 being held within the cup 3 by appropriate holding means of the type of those described above for the filling device.

As the piston head 7 is mounted by simple interlocking at the end of the pusher element 12, the piston head 7 is easily held within the cup 3. In the same way, this simple interlock mounting encourages installation of a new piston head 7 at the end of the pusher element 12. Thus, in such a filling arrangement, the piston head 7 works with the cup 3 to form a single-use filling device. Actually, once the transfer operation has been completed, the cup and the piston head 7 are removed from the filling arrangement and are replaced by a new cup 3 and a new piston head 7.

The piston head 7 works with the cup 3 to form, following the transfer stage, a cap called a transfer cap of an aerosol container 1. This piston head 7 likewise works with the cup 3, prior to or following the transfer stage, to form a cap called a transfer cap, of an aerosol container 1 to be filled.

In one particular embodiment of the arrangement, the pusher element 12 of the filling arrangement is equipped with means for detecting the presence of the piston head 7 in the fixed state on the pusher element 12. These detection means thus make it possible to prevent the transfer operation in the absence of the piston head 7 on the pusher element 12; this would lead to fouling of the pusher element 12.

Figure 4:
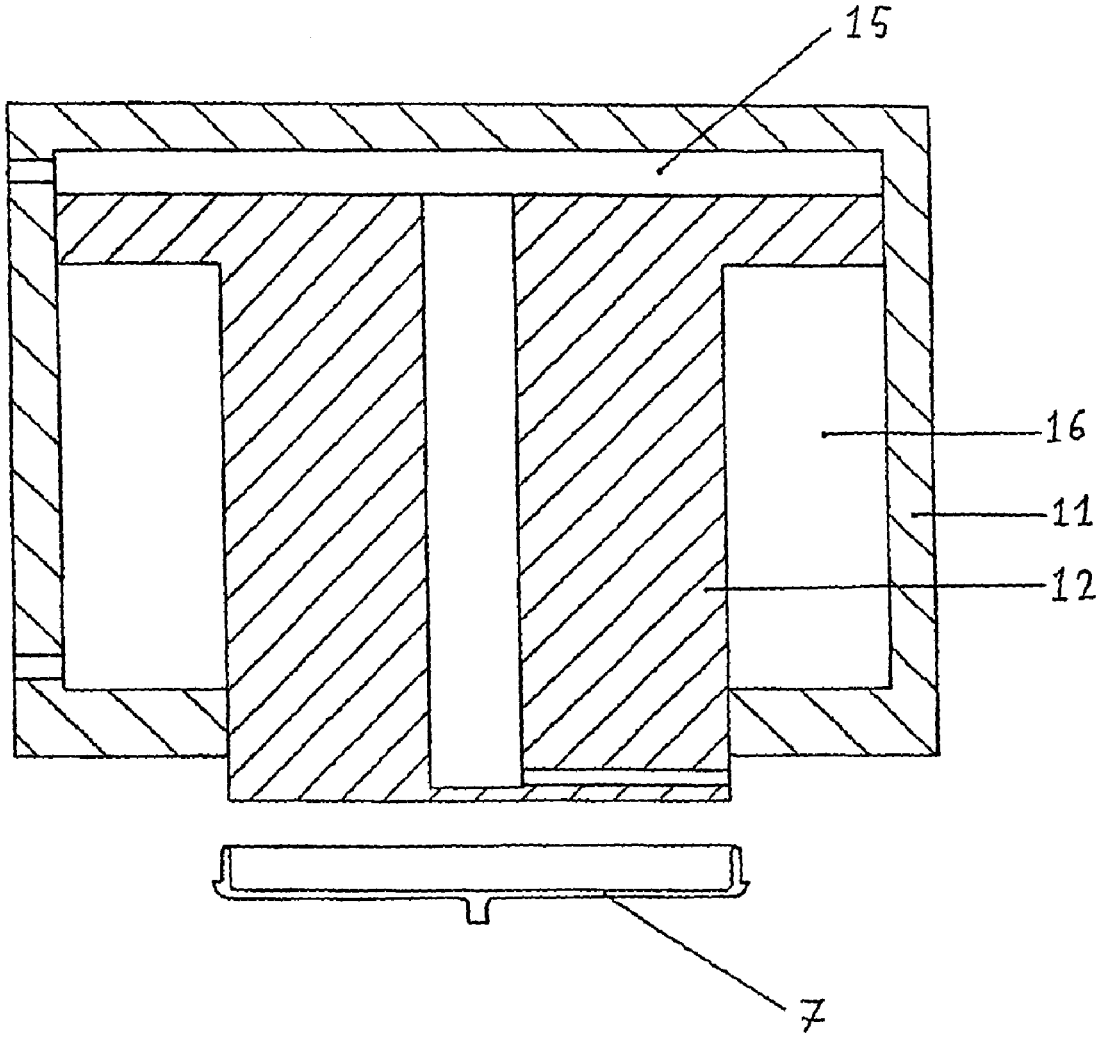
FIG. 4 shows a partial cutaway view of the pusher element of a filling arrangement according to the invention prior to mounting the piston head on the end of the pusher element.

One embodiment of such detection means is shown in FIG. 4. In this figure, the pusher element 12 is made in the form of a pneumatic cylinder that includes a first fluid-supplied chamber 15 that allows the exit of the cylinder rod. To allow implementation of the transfer stage, this pusher element is equipped with a second chamber 16 that is likewise supplied with a fluid to allow, conversely, retraction or return of the cylinder rod. This cylinder is therefore a double action-type cylinder. In the body of the piston rod of this cylinder, the fluid passes from the chamber 15 that causes the cylinder rod to extend or to exit as far as the end of the rod. The mouth of this fluid passage can only be closed during positioning of the piston head 7 on the cylinder rod. This closing then causes a rise in pressure of the chamber 15, causing displacement in the direction of extension of the cylinder rod and accordingly displacement of the assembly formed by the pusher element 12 and the piston head 7. In the case in which the piston head 7 is forgotten, the opening made in the piston rod discharges into the open air, thus preventing any pressure rise in the chamber 15 and ensuring movement of the cylinder rod in the direction of an extension of said rod. It is then impossible to perform the transfer operation.

Quite obviously, other embodiments of the means of detection of the presence of the piston head 7 can likewise be envisioned in an equivalent manner.

The invention claimed is

1. A device for filling an aerosol container (1) with a liquid or paint, using a filling arrangement equipped with a pusher element (12), the filling device comprising:

a cup (3) designed to accommodate the liquid or paint for filling the aerosol container (1);

an injection opening (4) provided on a bottom of the cup (3), the injection opening adapted to a valve (2) of the aerosol container (1);

a pusher element (12); and a piston head (7) acting by pushing on the filling liquid or paint contained in the cup (3) for transferring the filling liquid or paint from the cup (3) to the aerosol container (1), the piston head (7) being a detachable piston head that can be mounted by simple interlocking on an end of the pusher element (12) and later separated from the pusher element (12) within the cup, in an initial state before the transfer operation, the piston head (7) being coupled to the cup (3), in a detachable manner, against an outside face that forms the bottom of the cup (3), for use in the transfer operation, the piston head (7) is uncoupled from the cup and introduced in the cup, during the transfer operation, the piston head (7) is in the form of a scraper in continuous contact with an inside wall of the cup (3), the piston head (7) being shaped to work within the cup (3), and after the transfer operation is complete, the piston head (7) is kept within the cup (3) to form an airtight wall that retains residual liquid that has not been transferred from within the cup (3) during the transfer operation, wherein after a filling operation to fill the aerosol container, the piston head (7) is seated adjacent to the bottom of the cup to seal the bottom of the cup such that residual liquid or paint is visible through the bottom of the cup, and the piston head and the cup form a cap for the aerosol container.

2. The filling device according to claim 1, wherein the piston head (7) is kept within the cup (3) in a transfer completion position adjacent to the bottom of the cup (3) and in which the piston head (7) blocks the injection opening (4) of the cup (3).

3. The filling device according to claim 1, wherein the injection opening (4) of the cup (3) is extended externally by a projection (4A) that forms an injection nozzle that can be positioned on the valve (2) of the aerosol container (1), the nozzle being surrounded by a ring (6) that protects the end of the injection nozzle.

4. The filling device according to claim 1, wherein the piston head (7) comes in the form of a circular disk with a scraper segment (8) for radial airtightness, the disk being extended by a circular skirt (9) designed to encompass the pusher element (12), generally a cylinder.

5. The filling device according to claim 1, wherein the piston head (7) at a center of an outer surface thereof in contact with the liquid, has a projecting seal (10) that is designed to block the injection opening (4) of the cup (3) for airtightness.

6. The filling device according to claim 1, wherein the cup (3) in a vicinity of the opening (4) has an undercut (5) that forms an immobilizing element by working with an edge of the aerosol container (1) to constitute the cap of the aerosol container (1).

7. The filling device according to claim 1, wherein the cup (3) is made of a transparent or translucent material to allow in particular the nature of the transferred liquid to be viewed.

8. The filling device according to claim 1, wherein the cup (3) and the piston head (7) are single-use disposable articles.

9. The filling device according to claim 1, wherein the piston head (7) is disposable such that when the pusher element (12) is removed, a new piston head (7) can be installed for a new transfer operation.

10. The filling device according to claim 1, wherein the pusher element (12) is encompassed by the piston head (7).

* * * * *